US012366079B2

(12) United States Patent
Ovian

(10) Patent No.: US 12,366,079 B2
(45) Date of Patent: Jul. 22, 2025

(54) TRIANGULAR SHAPED PORTABLE TOILET

(71) Applicant: Mason Ovian, Whitinsville, MA (US)

(72) Inventor: Mason Ovian, Whitinsville, MA (US)

( * ) Notice: Subject to any disclaimer, the term of this patent is extended or adjusted under 35 U.S.C. 154(b) by 118 days.

(21) Appl. No.: 18/081,695

(22) Filed: Dec. 15, 2022

(65) Prior Publication Data

US 2024/0200348 A1 Jun. 20, 2024

(51) Int. Cl.
*E04H 1/12* (2006.01)
*E03D 9/04* (2006.01)

(52) U.S. Cl.
CPC ..... *E04H 1/1216* (2013.01); *E03D 9/04* (2013.01)

(58) Field of Classification Search
CPC ..... E04H 1/1216; E03D 9/04
USPC ..... 4/476, 312
See application file for complete search history.

(56) References Cited

U.S. PATENT DOCUMENTS 3,203,007 A * 8/1965 Olson ..... A47K 11/02 4/484
2009/0235445 A1* 9/2009 Goldstein ..... E04H 1/1216 4/476
2010/0058518 A1* 3/2010 Bourgeois ..... E04H 1/1216 4/144.1

FOREIGN PATENT DOCUMENTS

CN 112065110 A * 12/2020

* cited by examiner

*Primary Examiner* — Tuan N Nguyen
(74) *Attorney, Agent, or Firm* — John R. Ross; John R. Ross, III

(57) ABSTRACT

A triangular shaped portable toilet. Three toilet sides are connected to a triangular shaped toilet floor. A door is connected via hinges to one of the toilet sides. A triangular shaped roof is connected to the three toilet sides. A waste holding tank is connected to the floor and to two of the toilet sides. In a preferred embodiment, multiple portable toilets are arranged side-by-side to maximize space efficiency.

5 Claims, 16 Drawing Sheets

TRIANGULAR SHAPED PORTABLE TOILET

The present invention relates to toilets, and in particular, to portable toilets.

BACKGROUND OF THE INVENTION

Portable toilets are known in the prior art. Also known as a Porta Potty or a chemical portable toilet, a portable toilet is a movable, self-contained toilet solution. Most portable toilets feature at least a locking door, a waste tank positioned under a toilet seat and a urinal.

Portable toilets do not require a ground hole, a septic tank or connection to sewage lines. Chemical portable toilets should be treated with chemicals on a weekly basis to eliminate odors.

A mains connected portable toilet is a portable toilet that connects to sewage lines. These toilets can be flushed and don't need the same amount of chemical treatment. They are a good option for long-term construction projects located somewhere with full sewage and water connection.

Prior art portable toilets typically have a square or rectangular shaped cross section. The cross-section shape of a portable toilet may be unimportant if spatial efficiency does not matter. For example, if only one portable toilet is being used, the shape of the portable toilet may be irrelevant. However, often multiple portable toilets are set up adjacent to one another for an event or project where there may be a large number of people present. In such a case, an arrangement of a large number of portable toilets can waste valuable space.

What is needed is a better portable toilet that allows for increased space efficiency when multiple portable toilets are positioned near one another.

SUMMARY OF THE INVENTION

The present invention provides a triangular shaped portable toilet. Three toilet sides are connected to a triangular shaped toilet floor. A door is connected via hinges to one of the toilet sides. A triangular shaped roof is connected to the three toilet sides. A waste holding tank is connected to the floor and to two of the toilet sides. In a preferred embodiment, multiple portable toilets are arranged side-by-side to maximize space efficiency.

DETAILED DESCRIPTION OF THE PREFERRED EMBODIMENTS

Figure 1:
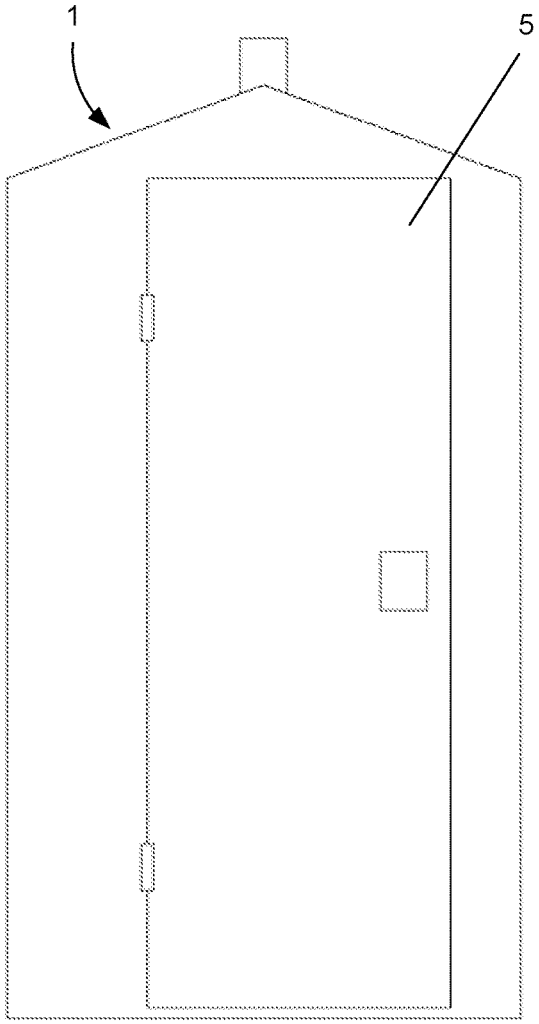
FIG. 1 shows a front view of a preferred portable toilet.
Figure 2:
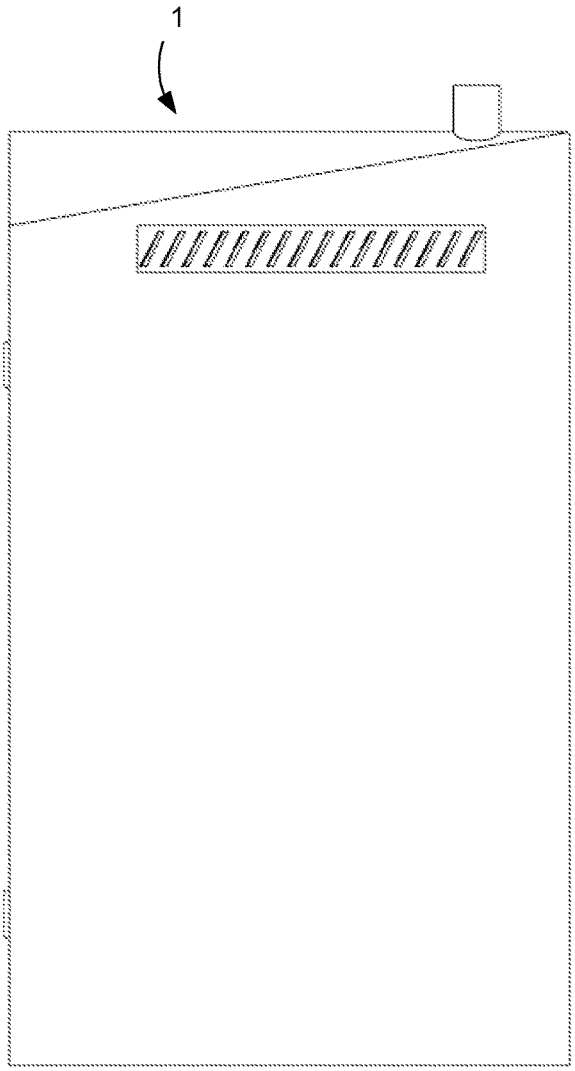
FIG. 2 shows a side view of the preferred portable toilet of FIG. 1.
Figure 3:
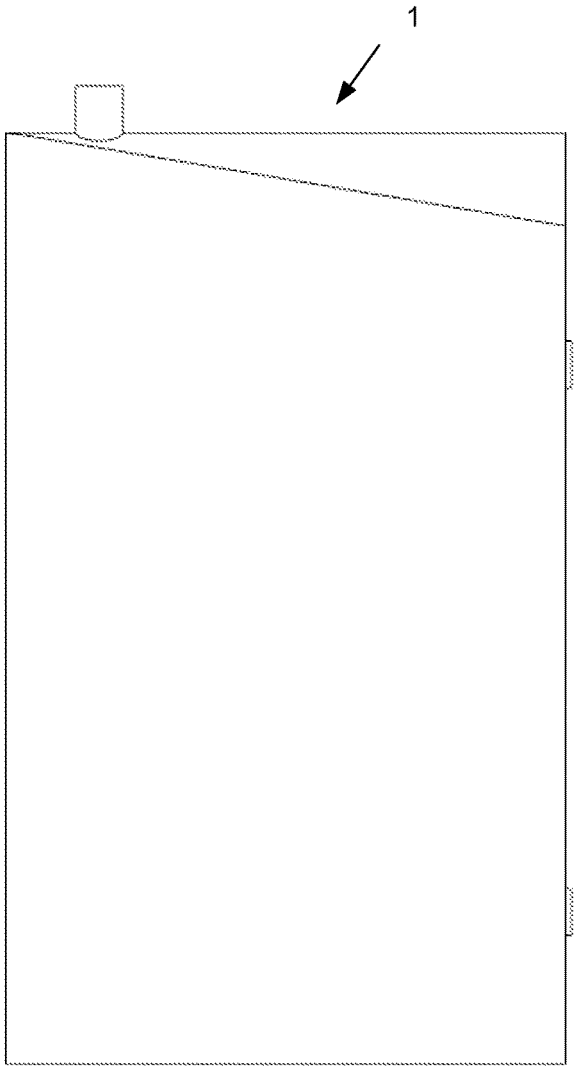
FIG. 3 shows another side view of the preferred portable toilet of FIG. 1.
Figure 4:
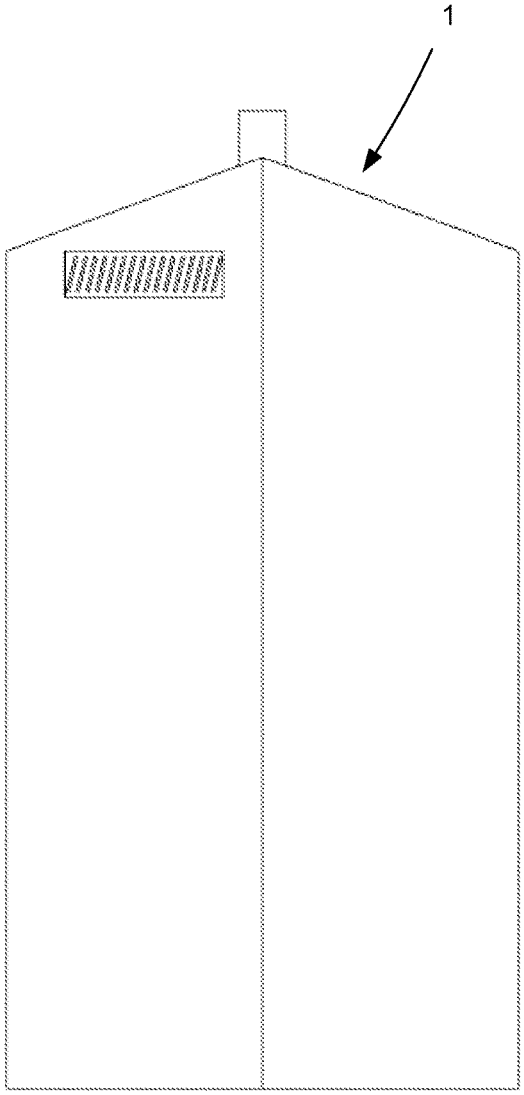
FIG. 4 shows another side view of the preferred portable toilet of FIG. 1.
Figure 5:
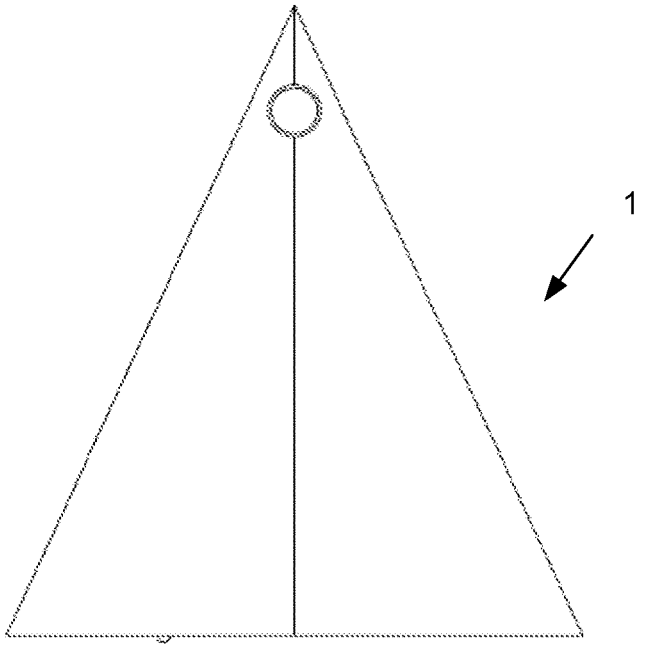
FIG. 5 shows a top view of the preferred portable toilet of FIG. 1.
Figure 6:
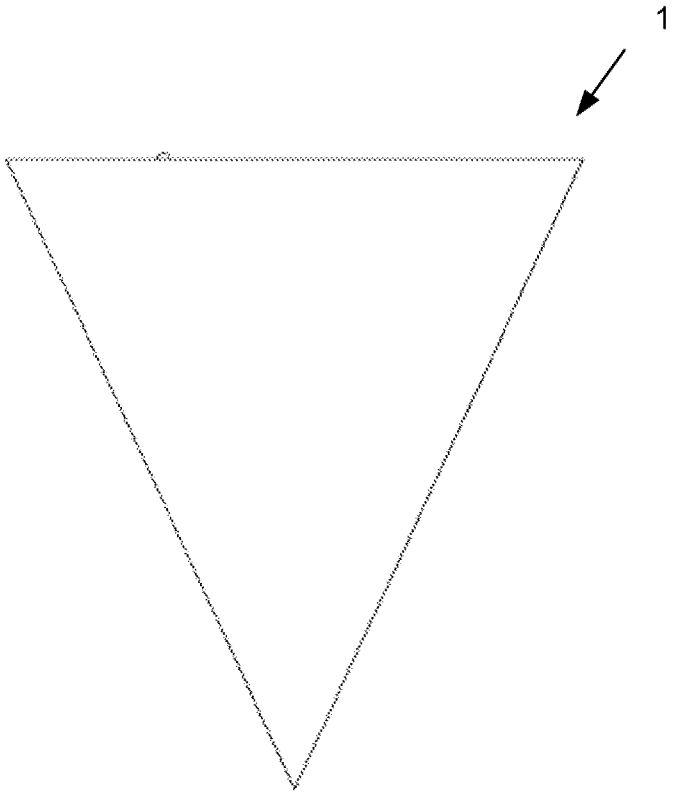
FIG. 6 shows a bottom view of the preferred portable toilet of FIG. 1.
Figure 7:
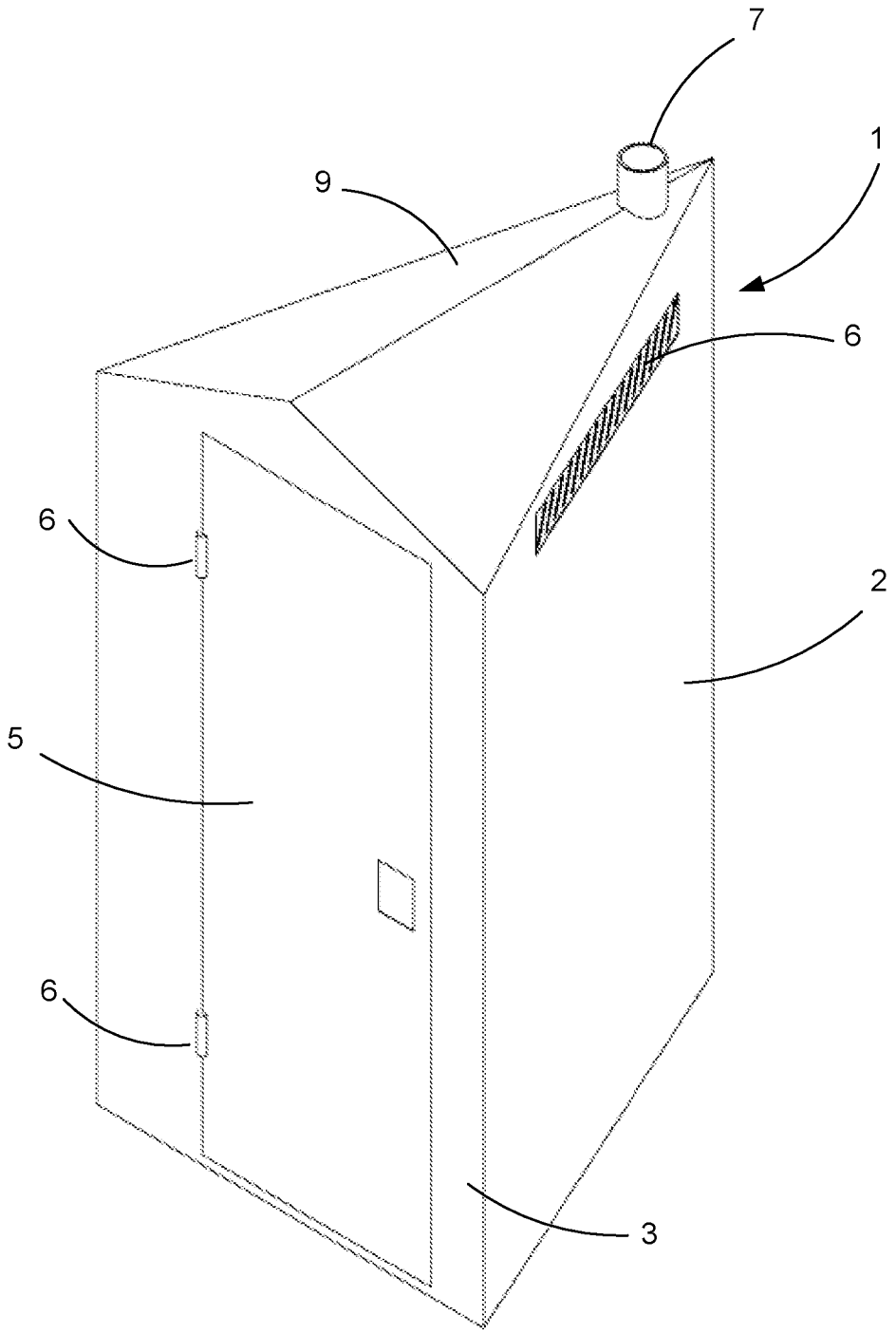
FIG. 7 shows a perspective view of the preferred portable toilet of FIG. 1.
Figure 8:
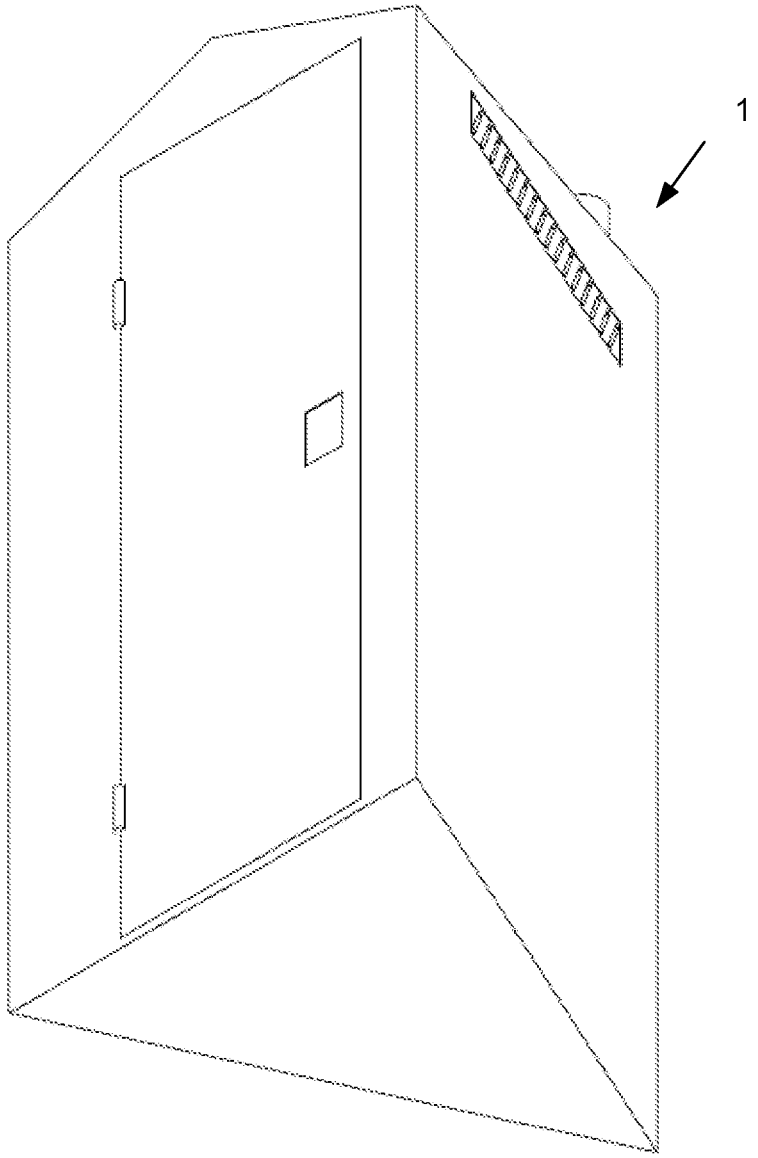
FIG. 8 shows another perspective view of the preferred portable toilet of FIG. 1.
Figure 9:
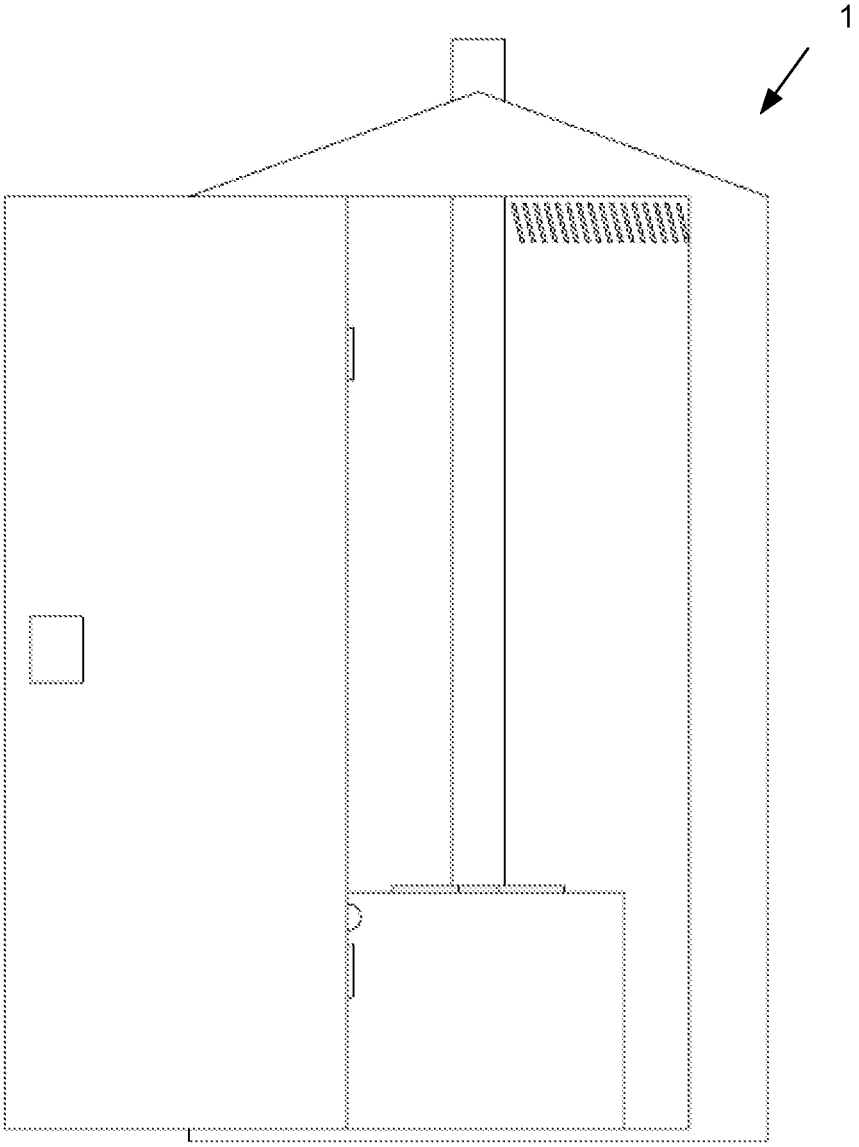
FIG. 9 shows a front view of a preferred portable toilet.
Figure 10:
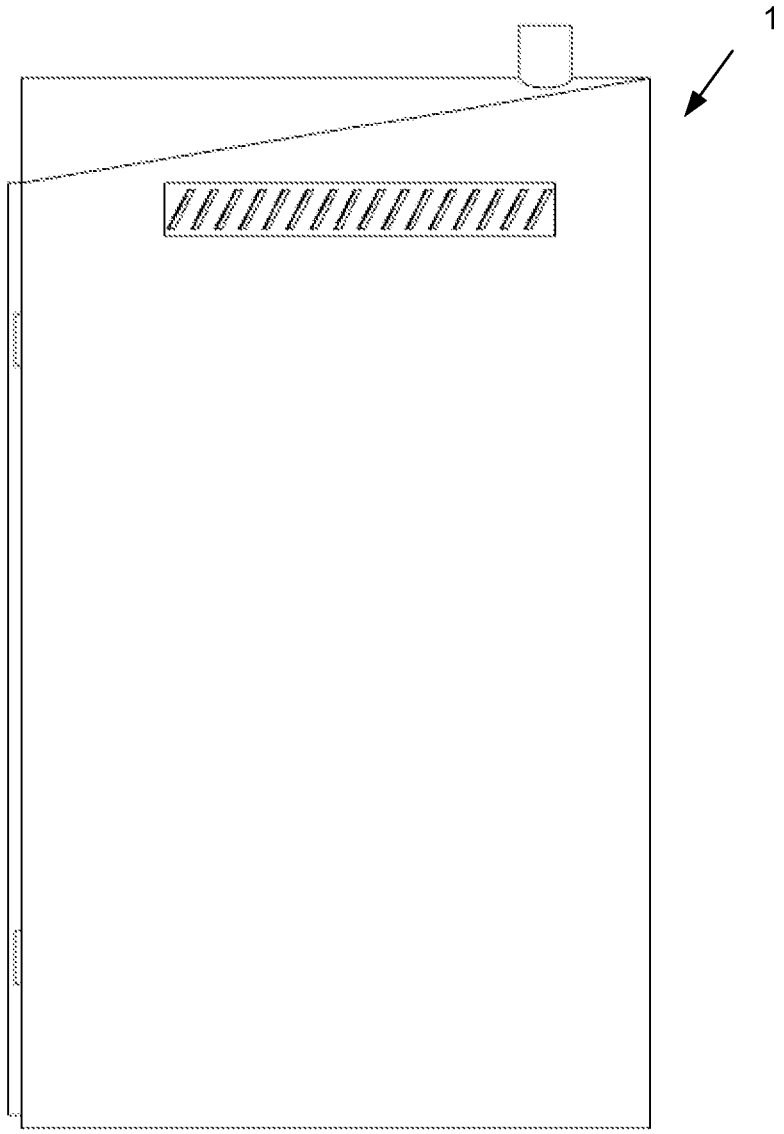
FIG. 10 shows a side view of the preferred portable toilet of FIG. 1.
Figure 11:
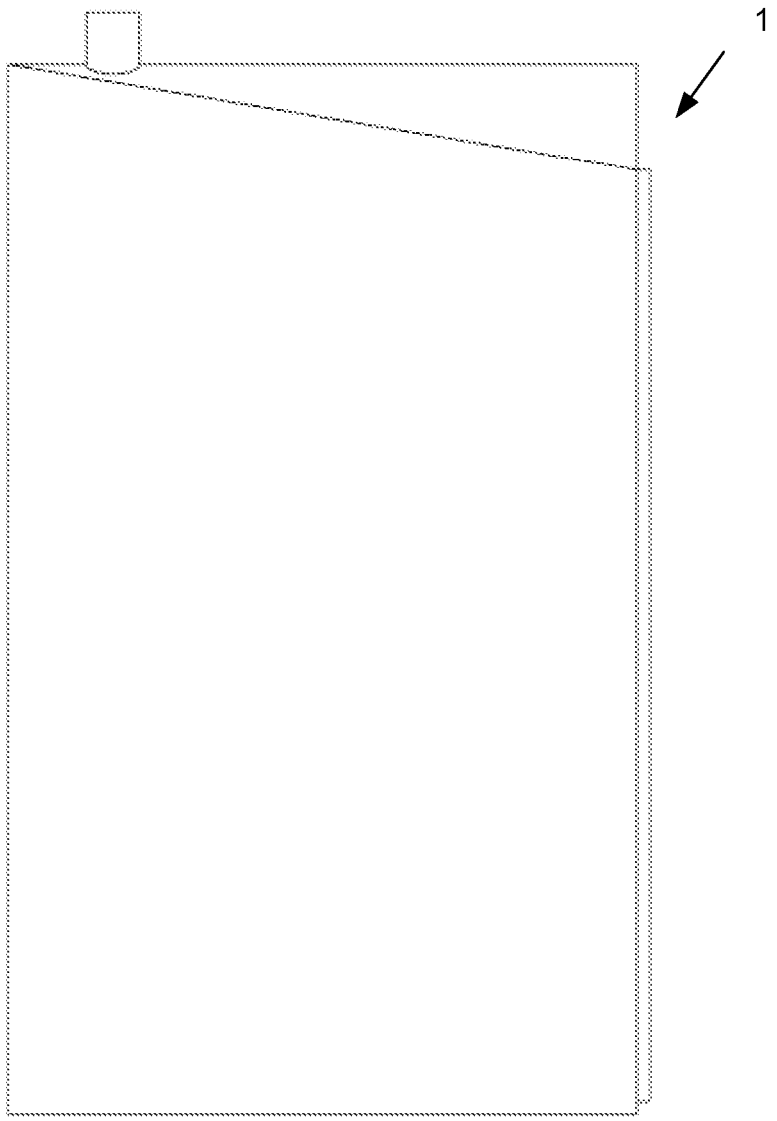
FIG. 11 shows another side view of the preferred portable toilet of FIG. 1.
Figure 12:
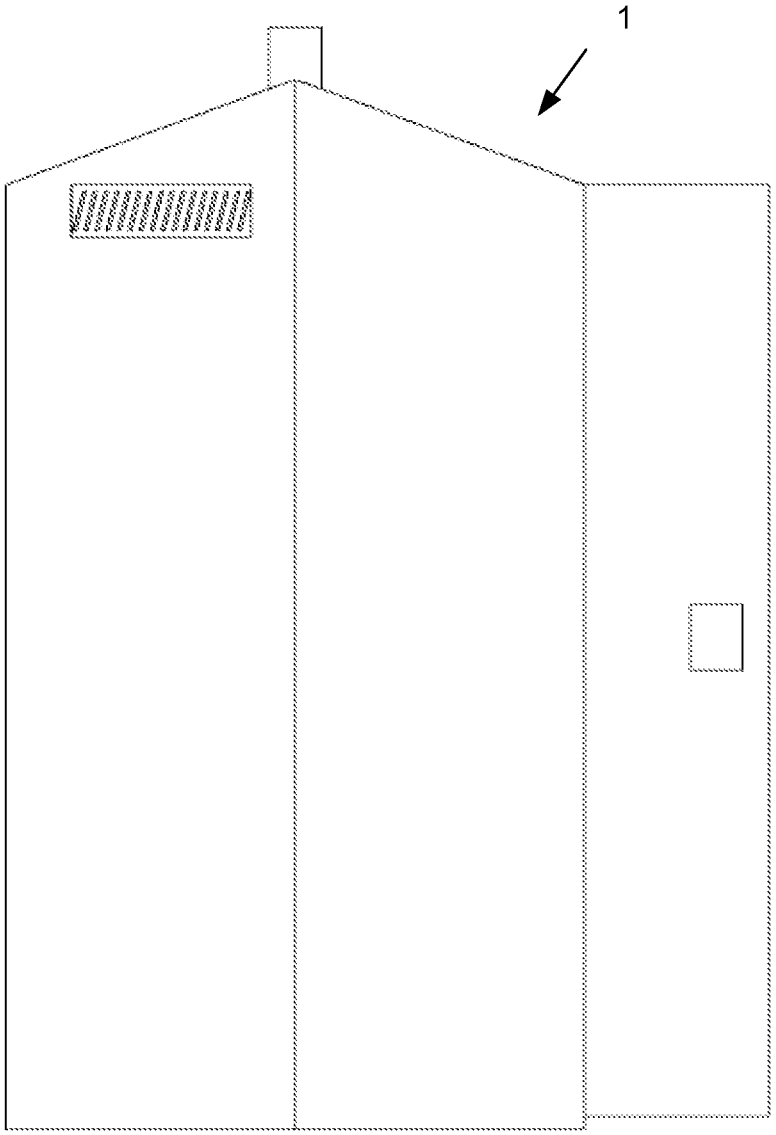
FIG. 12 shows another side view of the preferred portable toilet of FIG. 1.
Figure 13:
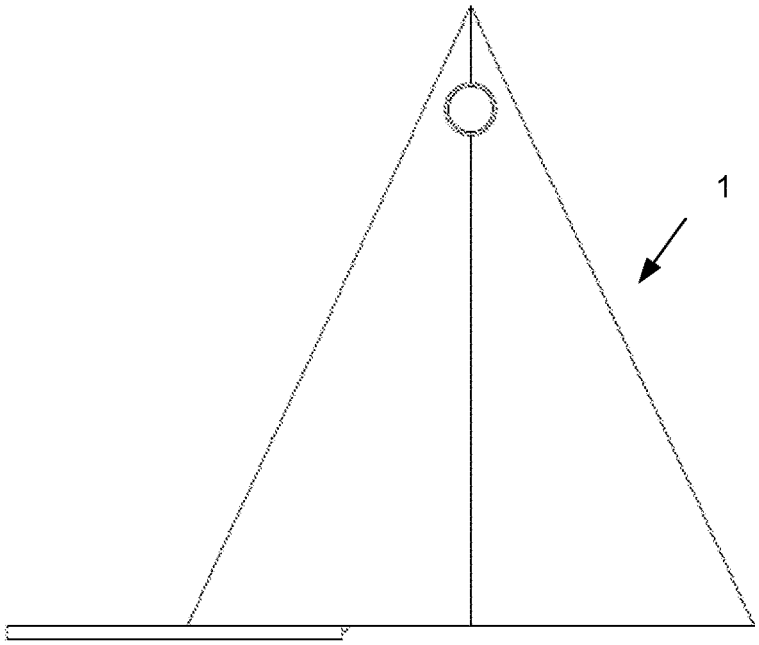
FIG. 13 shows a top view of the preferred portable toilet of FIG. 1.
Figure 14:
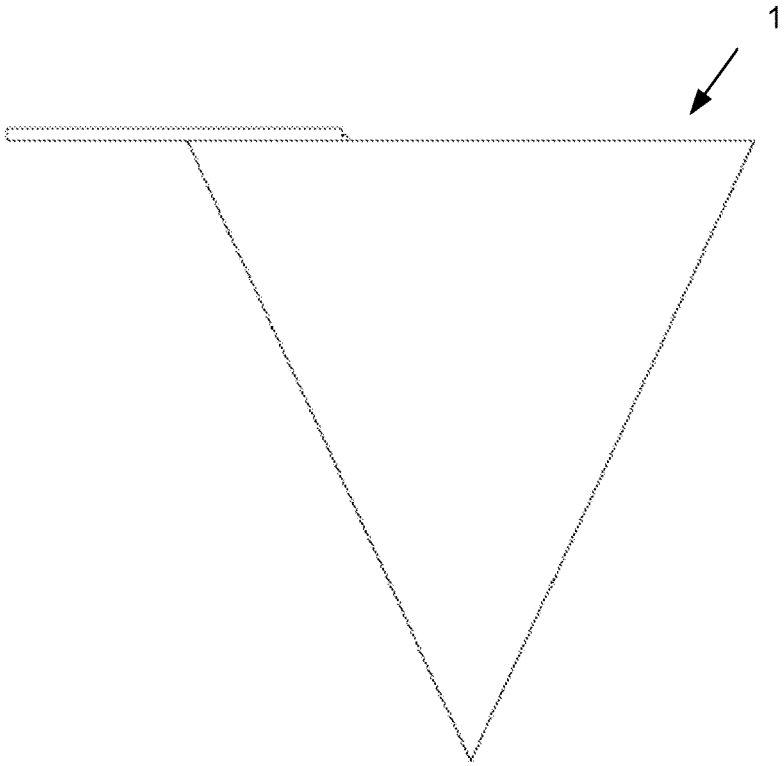
FIG. 14 shows a bottom view of the preferred portable toilet of FIG. 1.
Figure 15:
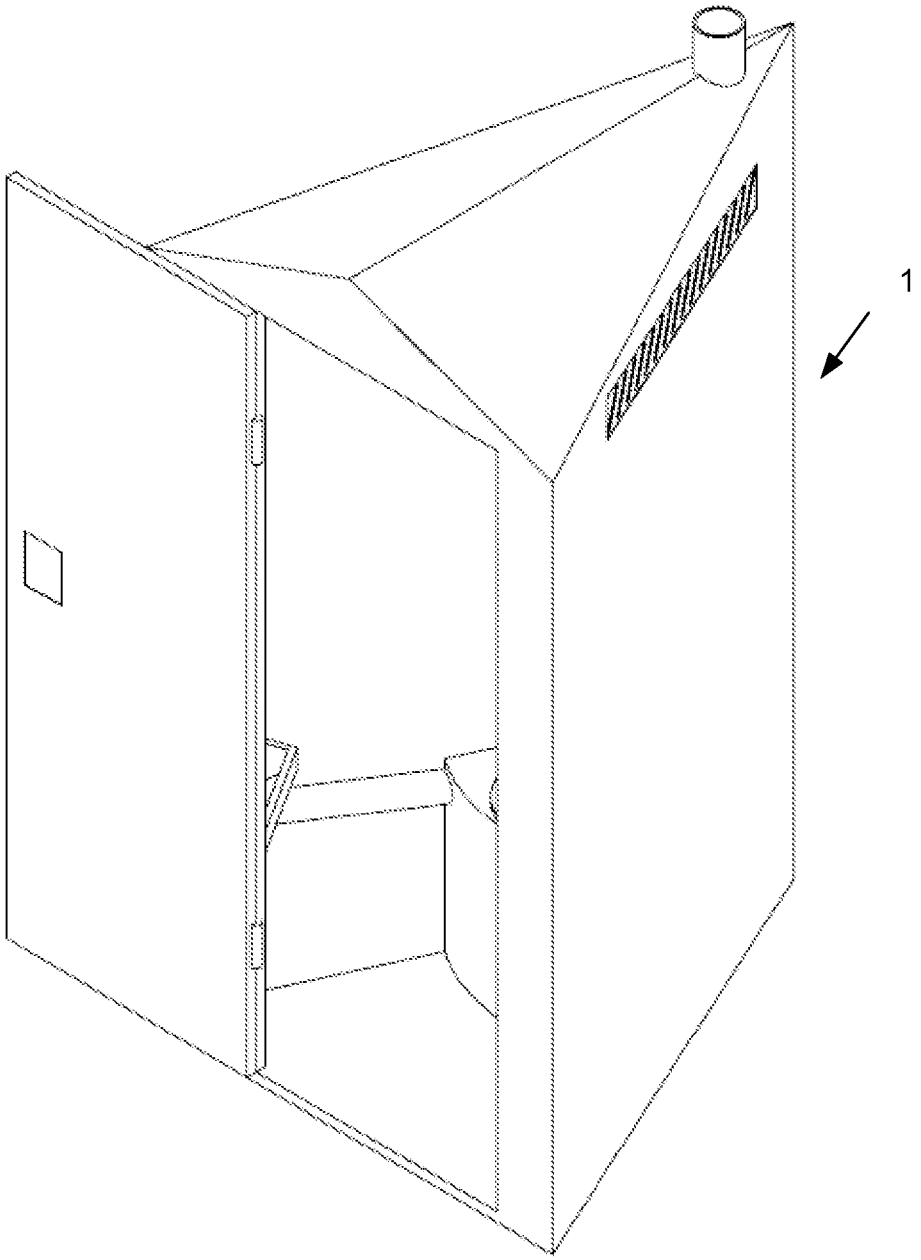
FIG. 15 shows a perspective view of the preferred portable toilet of FIG. 1.
Figure 16:
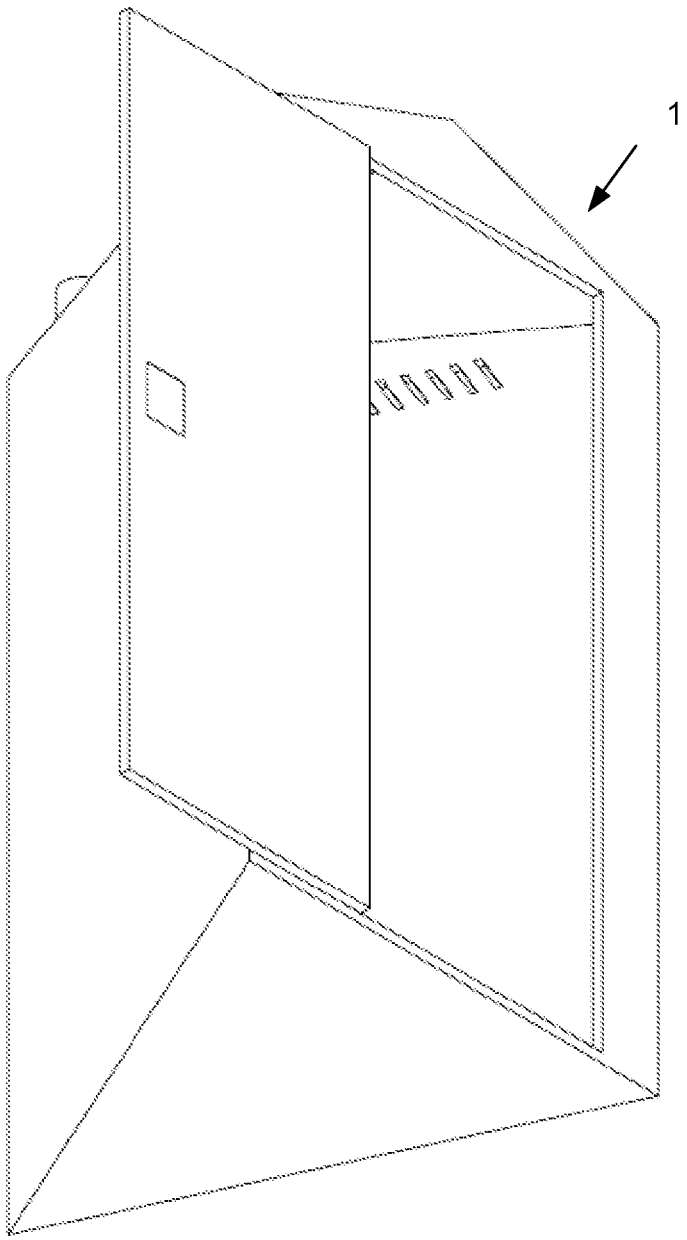
FIG. 16 shows another perspective view of the preferred portable toilet of FIG. 1.
Figure 17:
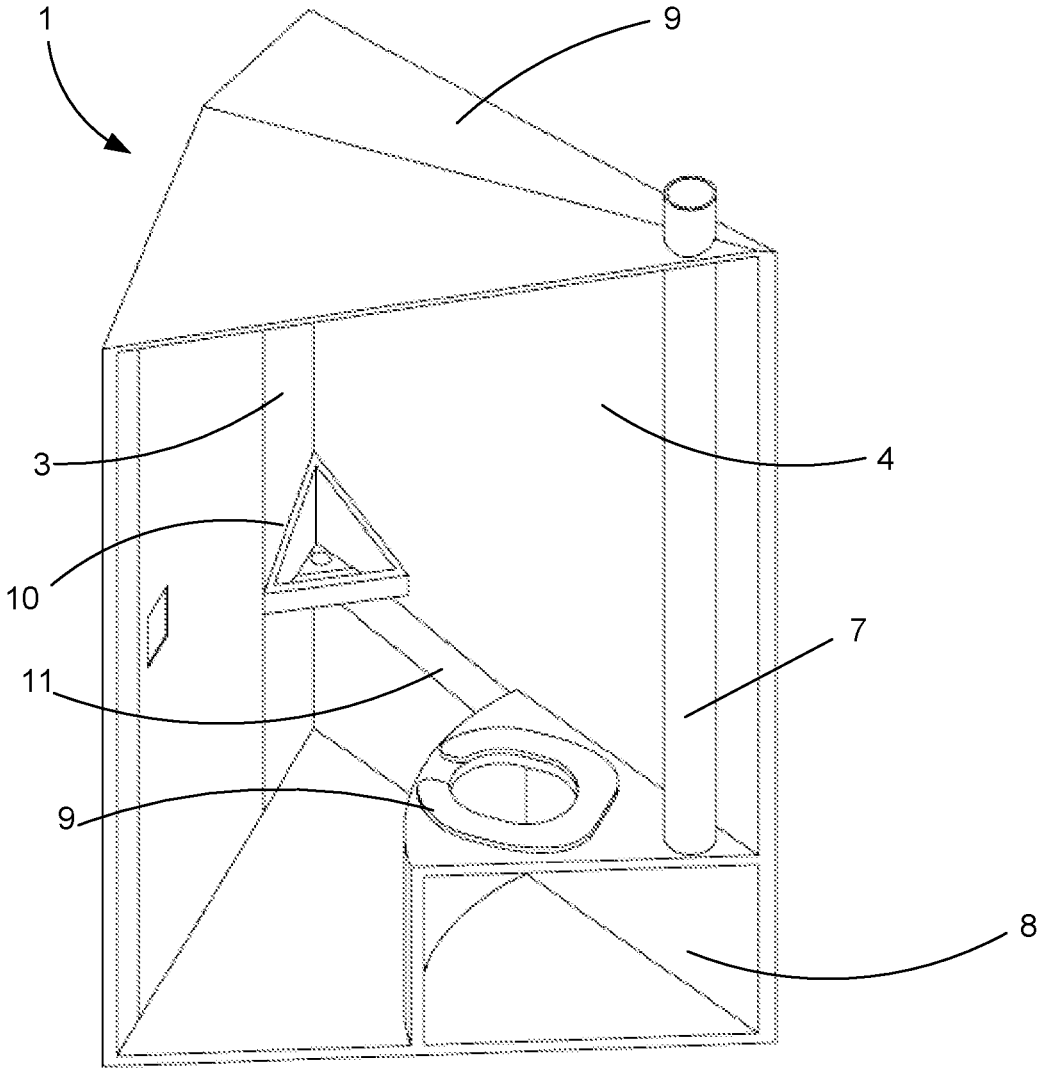
FIG. 17 shows a cutaway view of the preferred portable toilet of FIG. 1.

FIG. 7 shows a perspective view and FIG. 17 shows a cutaway view of preferred triangular shaped portable toilet 1. Portable toilet 1 includes three vertical sides 2, 3 and 4. Door 5 is connected to vertical side 2 via hinges 16. Vent 6 is connected to vertical side 2 and provides ventilation and cooling to toilet 1. Vent pipe 7 is connected to holding tank waste holding tank 8 and extends upwards from tank 8 through triangular shaped roof 9. Toilet seat 9 is positioned over the top of tank 8. Tank 8 is pie shaped and is rigidly connected to toilet 1. Tank 8 rests on triangular shaped floor 14 and is positioned at the intersection of sides 2 and 4 at the vertices opposite door 5, as shown. Urinal 10 is rigidly connected to toilet 1 and positioned at the intersection of sides 3 and 4. As shown in FIGS. 1 and 7, door 5 has been mounted so that it is positioned close to the intersection between sides 2 and 3 to allow for more room to mount urinal 10 at the intersection between sides 3 and 4. Urinal pipe 11 connects urine from urinal 10 to tank 8.

Figure 18:
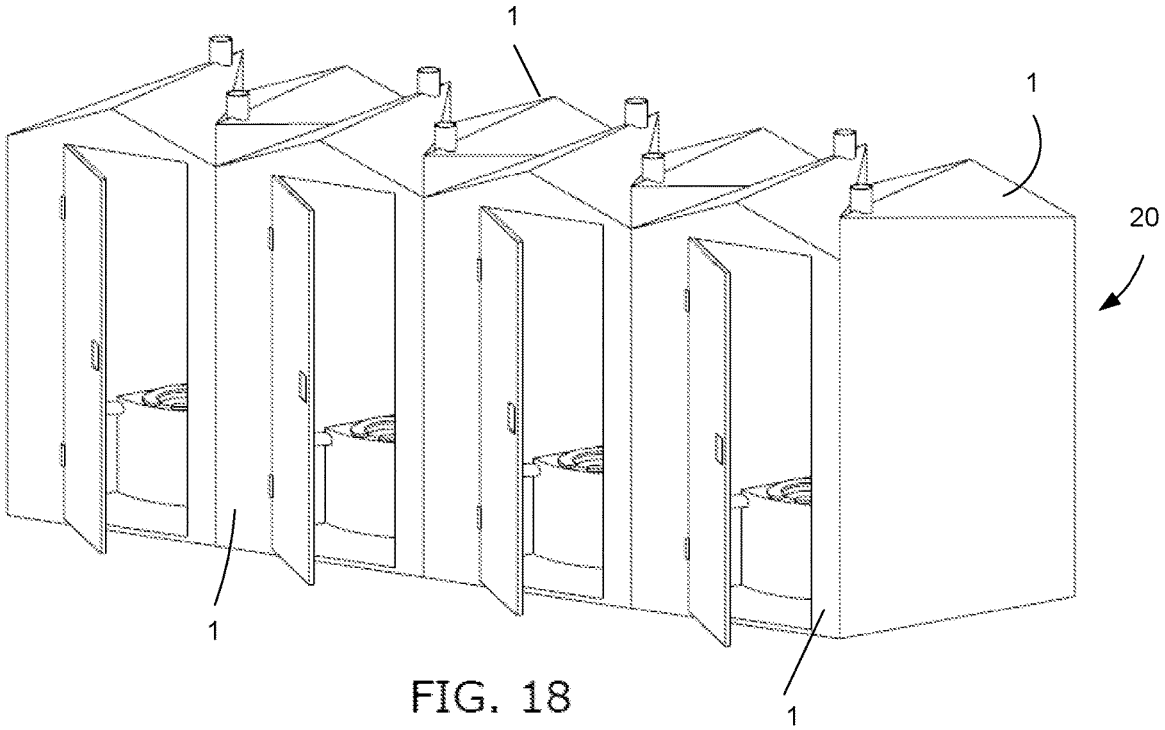
FIGS. 18 and 19 show a linear arrangement of multiple preferred toilets.
Figure 19:
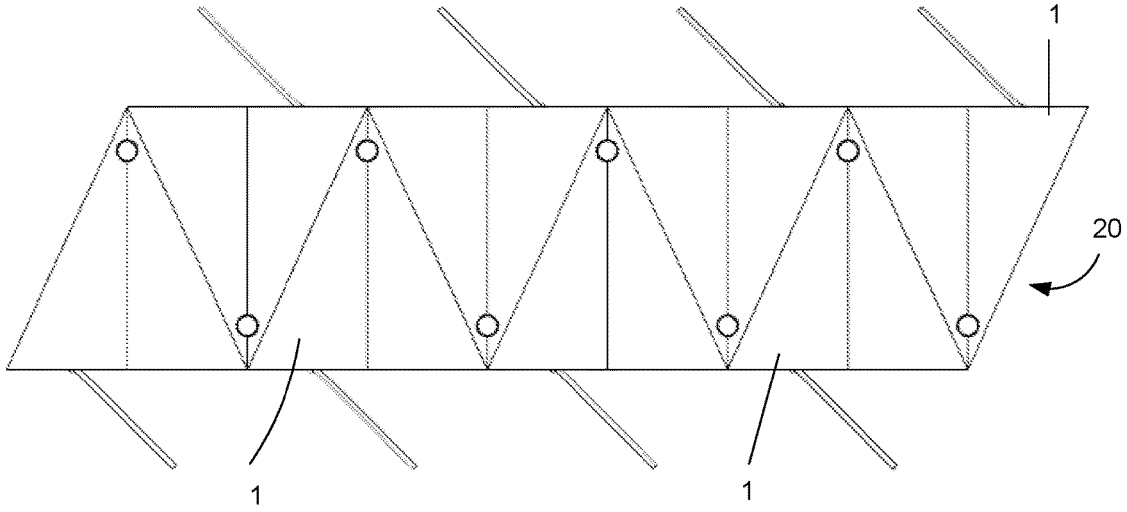
Figure 20:
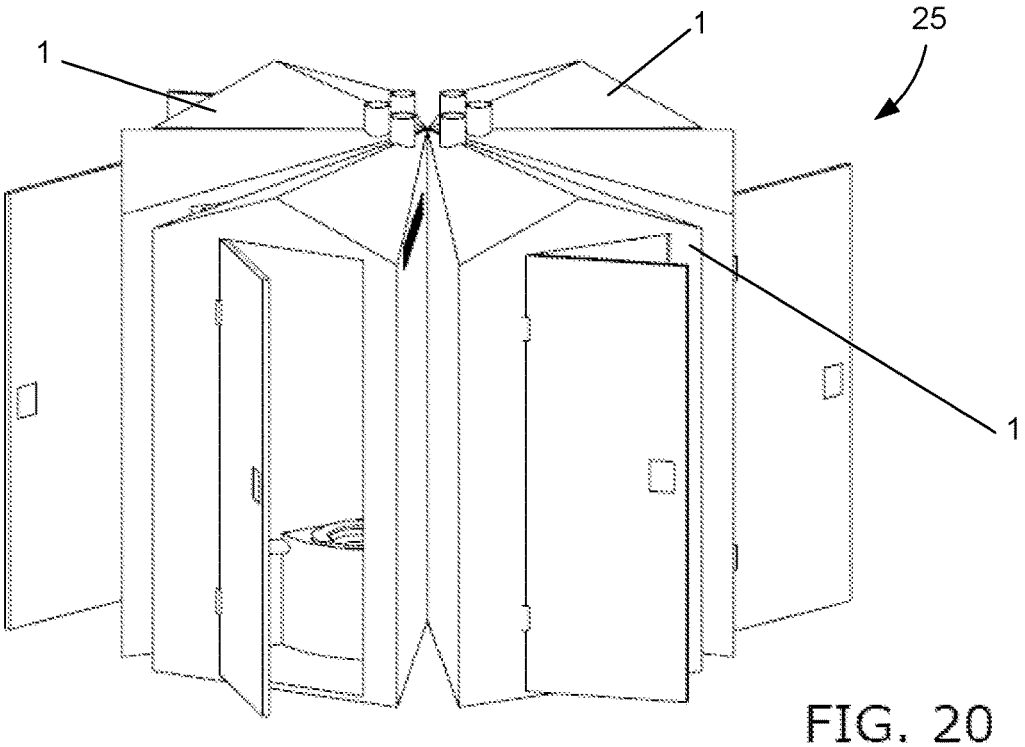
FIGS. 20 and 21 show a circular arrangement of multiple preferred toilets.
Figure 21:
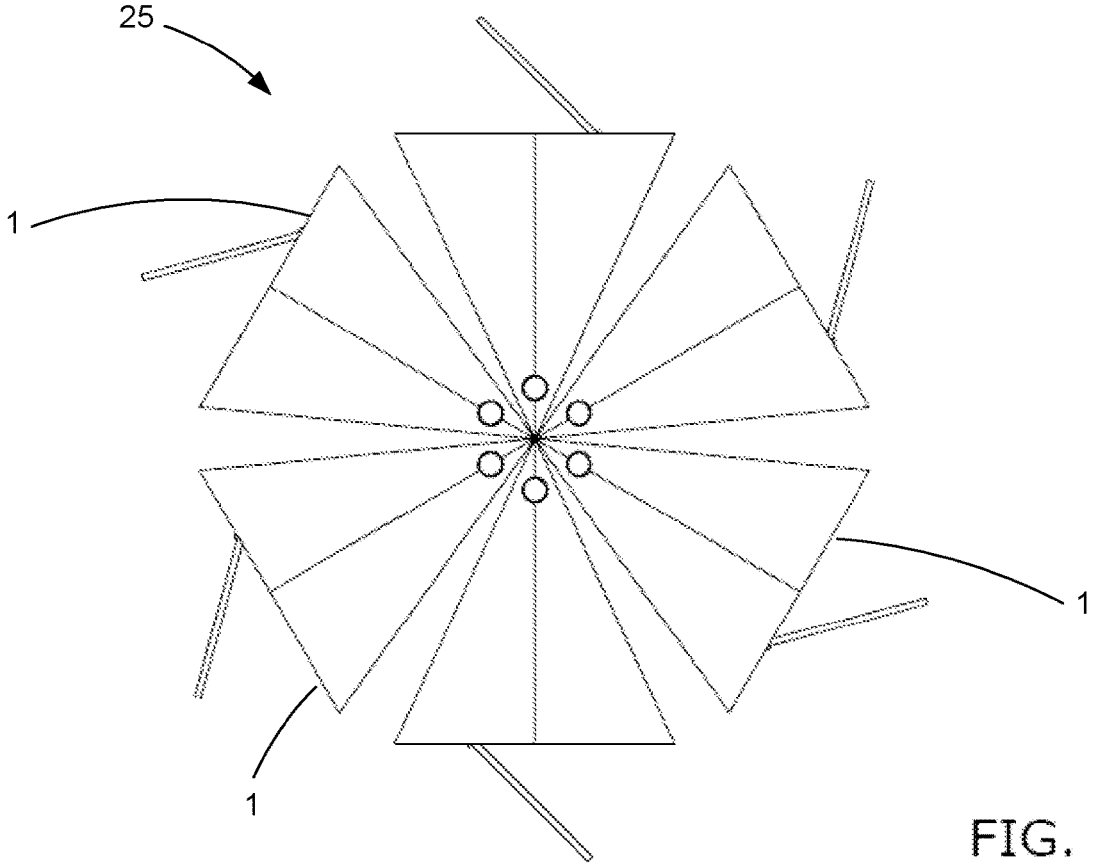
Figure 22:
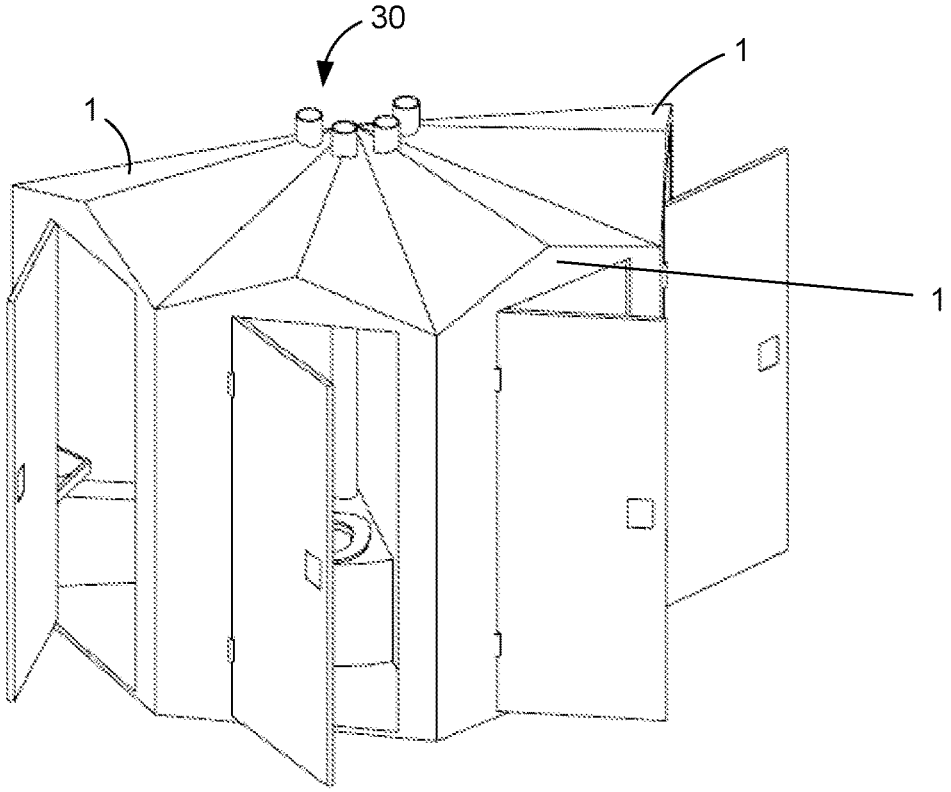
FIGS. 22 and 23 show a partial circular arrangement of multiple preferred toilets.
Figure 23:
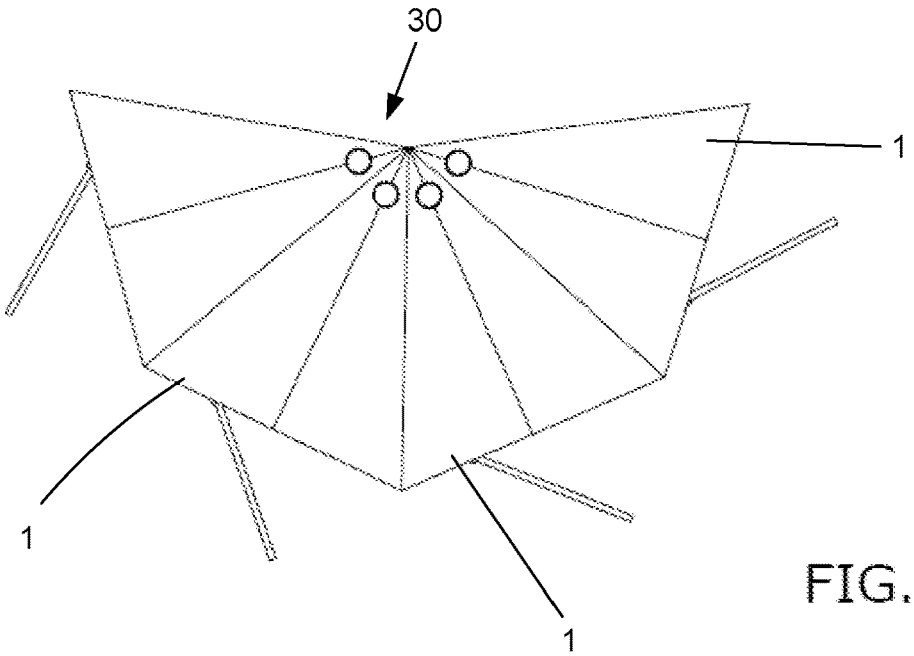

Arrangement of Multiple Triangular Shaped Toilets to Maximize Space Efficiency In a preferred embodiment multiple toilets 1 are placed adjacent to one another to maximize space efficiency. For example, FIG. 18 shows a perspective view and FIG. 19 shows a top view of multiple portable toilets 1 arranged side-by-side to form linear arrangement 20. Also, FIG. 20 shows a perspective view and FIG. 21 shows a top view of multiple portable toilets 1 arranged side-by-side to form circular arrangement 25. Also, FIG. 20 shows a perspective view and FIG. 21 shows a top view of multiple portable toilets 1 arranged side-by-side to form partial circular arrangement 30.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A portable toilet comprising:

A. a triangular shaped toilet floor,

B. three toilet sides connected to said triangular shaped toilet floor,

C. a door hingedly connected to one of said three toilet sides,

D. a triangular shaped roof connected to said three toilet sides,

E. a waste holding tank connected to said floor and two of said three toilet sides F. a toilet seat positioned over said waste holding tank, G. an internal urinal connected to two of said three toilet sides, H. an internal urinal pipe leading from said urinal to said waste holding tank, and I. a vent pipe extending from said waste holding tank through said portable toilet.

2. The portable toilet as in claim 1 wherein said waste holding tank is pie shaped.

3. The portable toilet as in claim 1, wherein said portable toilet is a plurality of portable toilets positioned side-by-side to form a linear arrangement.

4. The portable toilet as in claim 1, wherein said portable toilet is a plurality of portable toilets positioned side-by-side to form a circular arrangement.

5. The portable toilet as in claim 1, wherein said portable toilet is a plurality of portable toilets positioned side-by-side to form a partial circular arrangement.

* * * * *